United States Patent [19]

Chung

[11] Patent Number: 4,732,552

[45] Date of Patent: Mar. 22, 1988

[54] FIBER PROCESSING APPARATUS HAVING SLOTTED OUTLETS

[75] Inventor: Raymond Chung, Fulton County, Ga.

[73] Assignee: Kimberly-Clark Corporation, Neenah, Wis.

[21] Appl. No.: 612,522

[22] Filed: May 21, 1984

[51] Int. Cl.[4] ..... B28B 5/00

[52] U.S. Cl. ..... 425/82.1; 264/140; 264/147; 264/518; 425/83.1

[58] Field of Search ..... 264/518, 140, 147; 425/82.1, 83.1, 80.1; 19/28

[56] References Cited

U.S. PATENT DOCUMENTS 4,375,447 3/1983 Chung ..... 264/518

*Primary Examiner*—Peter Chin

*Attorney, Agent, or Firm*—Gregory E. Croft; Donald L. Traut; Jeremiah J. Duggan

[57] ABSTRACT

The throughput of an apparatus for processing fibrous materials is increased by a fiber outlet portion consisting essentially of a plurality of dividers oriented in a direction perpendicular to the direction of travel of the impact elements (such as hammers and rotor blades), said dividers having a leading surface which is inwardly slanted in the direction of travel of the impact elements and dividers being separated by continuous or semi-continuous slots.

9 Claims, 8 Drawing Figures

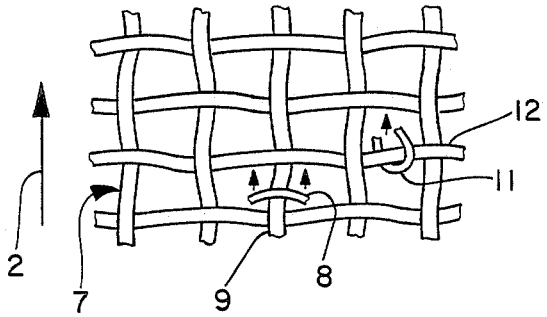
FIG. 2A
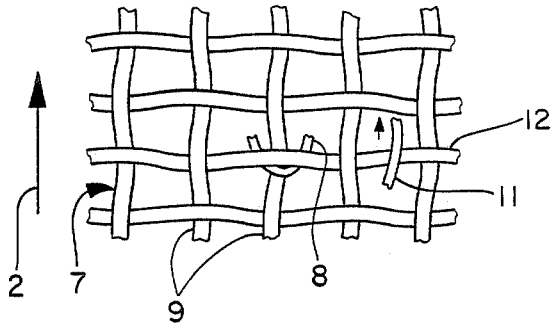
FIG. 2B
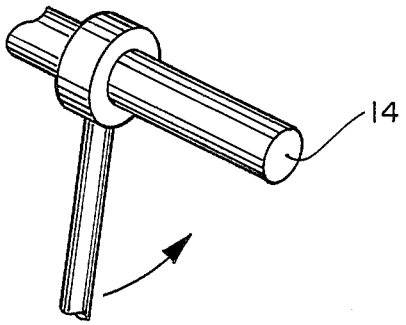
FIG. 3
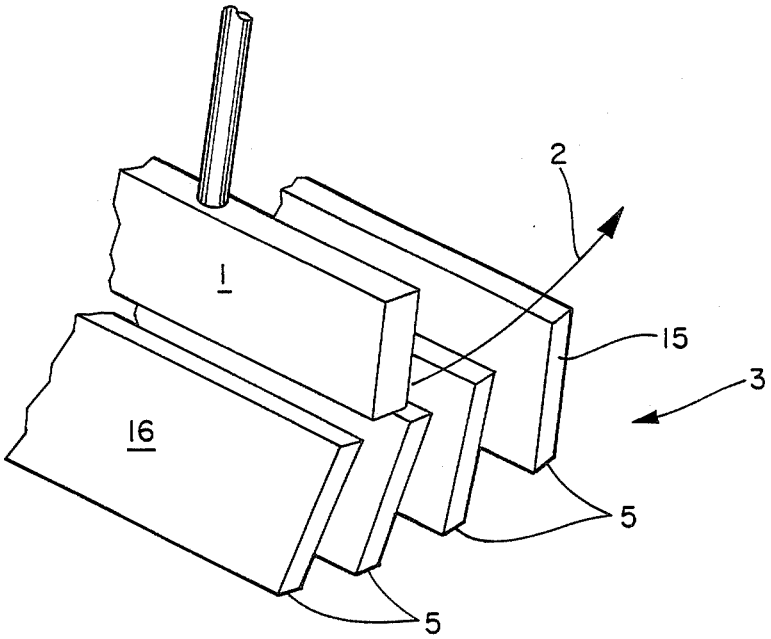

FIBER PROCESSING APPARATUS HAVING SLOTTED OUTLETS

BACKGROUND OF THE INVENTION

In the papermaking industry and the personal care field, it is common practice and well known to fiberize various cellulosic feedstocks for a variety of purposes. For example, in manufacturing airlaid tissue products, it is necessary to first reduce pulp sheets to individual fibers prior to depositing the fibers onto a forming wire. In the infant care and feminine care areas, pulp sheets are fiberized for making fluff for diapers and feminine products.

Many different types of apparatus are available for these purposes which can generally be classified into two categories, namely fiberizers and formers. Fiberizers, such as hammermills, serve to fiberize crude feedstocks, such as pulp sheets and waste paper, breaking down these feedstocks into a loose fibrous mass and individual fibers. On the other hand, formers are generally fed individual fibers or loosely bound fiber batts produced by a fiberizer and serve to lay the fibers evenly on a forming wire. There may be some overlap in the function of any given apparatus in that formers may accomplish some fiberization and fiberizers may be used to lay down fibrous batts. But all the different types of apparatus used for processing fibers share the common function of expelling individual fibers through an outlet while preferably retaining any clumps, nits, pills, or the like within the apparatus until they are sufficiently broken down or expelled through a separate recycle orifice. This is accomplished within a chamber enclosing arcuately travelling impact elements, such as blades or hammers, which thrust the fibers or fibrous material against the inner surface of the chamber. A portion of this inner surface contains an outlet having a large number of orifices through which small particles and individual fibers pass as the product of the apparatus. In the case of fiberizers and some formers, these orifices generally consist of holes drilled through the wall of the inner surface. In other formers, these orifices can also be mesh openings in a screen.

A problem which inevitably occurs with all prior apparatus of this type is that the outlet orifices become plugged with fibers at some level of throughout capacity, i.e. the throughput of the apparatus can be increased only so far, at which point it becomes plugged. Oftentimes this capacity limit is reached at an unacceptably low level of throughput. The apparatus illustrated in U.S. Ser. No. 4,375,447 to Chung and U.S. Pat. No. 4,375,448 to Appel et al utilize a slotted screen to overcome these problems, but the use of a woven screen still presents plugging problems, even if the screen openings are elongated rather than square.

Therefore, there exists a need for an apparatus for processing fibers which minimizes or inhibits plugging of the outlet orifices and therefore is capable of higher throughput capacity.

SUMMARY OF THE INVENTION

In general, the invention resides in an apparatus for processing fibers or fibrous materials having arcuately travelling impact elements enclosed within a chamber by an internal surface arcuately spaced apart from said impact elements, wherein said chamber contains an outlet having a multiplicity of openings through which fibers leave the apparatus, the improvement comprising an outlet consisting essentially of a plurality of spaced-apart dividers aligned in a direction perpendicular to the direction of travel of the impact elements and having a leading surface or portion thereof which is inwardly slanted in the direction of travel of the impact elements, said dividers being separated by continuous or semi-continuous slots. It has been discovered that by designing the chamber outlet in this manner, plugging problems are greatly reduced and throughput capacity is increased.

For purposes herein, the term "apparatus" is intended to include fiberizers and formers unless otherwise stated. The term "impact element" is a general term referring to the extremity of any rotating element within the apparatus serving to move fibers or fibrous materials around the periphery of the chamber including, without limitation, blades as used in formers and hammers as used in hammermills. The term "continuous slot" means an uninterrupted elongated opening in the outlet that extends the width of the apparatus. The term "semi-continuous slot" means a continuous slot which has a minimal number of surface interruptions connecting opposite sides of the slot. Semi-continuous slots may be a necessity if the width of the apparatus is sufficient to require structural support between opposite sides of the slots at certain intervals. The adverse effects caused by the presence of such structural supports can be minimized if the supports are located sufficiently below the innermost edge of the divider to avoid interfering with fiber passage into the outlet. The term "direction of travel of the impact element" refers to a vector representing the instantaneous or tangential direction of travel of a particular impact element relative to a given point when the impact element is positioned as close to the given point as possible. Accordingly, the direction of travel of an impact element is different for each point on the internal surface falling along the arcuate path of the impact element. This concept is further discussed in connection with FIG. 4.

It has been discovered that in an apparatus which uses a screen for the outlet of the chamber, one of the mechanisms of plug formation is for individual fibers to drape themselves over the wires running in direction of travel of the impact elements. The air currents in the apparatus cause the draped fiber to slide in the direction of travel of the impact element until it contacts a wire oriented in the perpendicular direction, where it becomes lodged into the crevice formed by the intersecting wires. This occurrence repeats itself with different fibers until enough fibers collect to plug the orifice. It has been noted that very little plugging is due to the fibers draping themselves over one of the wires which run perpendicular to the direction of travel of the impact element. This is apparently because the air currents created by the impact elements urge any such fibers to continue to move in the direction of travel of the impact elements, thereby eventually working the fibers free of the wire.

The apparatus of this invention takes advantage of this discovery by eliminating, to the extent possible taking structural limitations into account, all or most of any solid surfaces within the outlet which are oriented parallel to the direction of travel of the passing impact elements. Hence the dividers of this invention within the outlet are aligned or oriented generally perpendicularly to the direction of travel of the impact elements and they are separated by continuous or semi-continuous slots.

In addition, another reason for the improved performance of the apparatus of this invention is that the leading surface of the inner edge of the dividers is inclined in the direction of travel of the passing impact elements. With this arrangement, aggregates of fibers which approach the outlet strike the leading surfaces of the dividers and deflect back into the chamber to be further fiberized or recycled rather than plugging or passing through the slot. Hence the apparatus of this invention serves to classify fibers or agglomerates according to their mass:surface area ratio. The heavier aggregates have sufficient momentum to deflect off the leading surface, while the lighter individual fibers and aggregates can follow the air currents into the slot.

The operation of the apparatus of this invention will be described in greater detail by reference to the Drawing. cl BRIEF DESCRIPTION OF THE DRAWING FIG. 1 shows a cross-sectional view of an apparatus for processing fibers having an outlet in accordance with this invention.

FIGS. 2A and 2B show plan views of a wire screen being used in a prior art outlet illustrating plug formation resulting from individual fibers draping over wires oriented in the direction of travel of the impact element.

FIG. 3 shows a perspective view of a segment of the outlet of an apparatus in accordance with this invention.

DETAILED DESCRIPTION OF THE INVENTION

Figure 1:
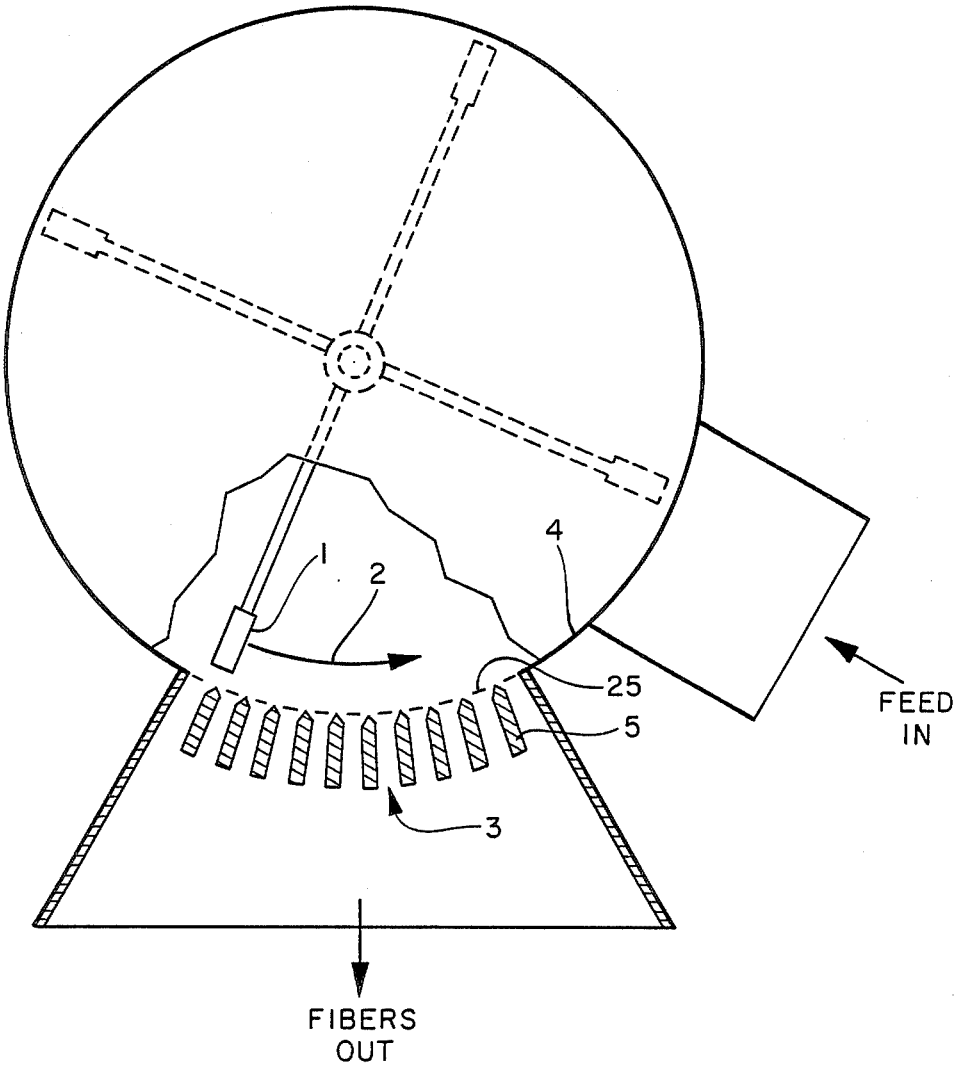

Directing attention FIG. 1, the invention will be described in greater detail. In order to provide a proper setting for the following Figures, FIG. 1 generally shows a cross-sectional view of an apparatus of this invention having a feed inlet, arcuately travelling impact elements 1 which travel along an arcuate path 2, and an outlet, generally designated by reference numberal 3, disposed within a chamber defined by the internal surface 4 of the apparatus. Although not shown, the internal surface can contain protrusions and depressions for the purpose of fiberizing the feed material. The outlet suitably contains supported spaced-apart metal plates 5 (dividers) through which fiberized materials leave the apparatus. Any number of plates can be used as desired for optimal throughput. The relative positions of the feed inlet and the outlet 3 can vary depending on the specific application. For example, if the feed were to be partially fiberized materials, the inlet could be as close to the outlet as is practical. On the other hand, if the feed were to be large pieces of materials such as keypunch cards, ledger paper, etc., then locating the outlet as far from the inlet as possible (as shown) is preferred in order to give the apparatus sufficient opportunity to complete the fiberization by working the material against the entire periphery of the internal surface of the apparatus. Also shown in FIG. 1 is dashed line 25 which is an imaginary extension of the internal surface 4.

FIGS. 2A and 2B illustrate how fibers are believed to clog a prior art apparatus which has an outlet containing a wire screen as previously discussed. Shown is the wire mesh screen 7, a fiber 8 which is draped or stapled across a wire 9 which is aligned parallel to the direction of travel of the impact elements as indicated by arrow 2. Also shown is another fiber 11 which is draped or stapled across a wire 12 aligned perpendicularly to the direction of travel of the impact elements. The operation of the apparatus illustrated in FIGS. 2A and 2B is such that the individual fibers are intended to leave the apparatus through the mesh openings in the screen by passing into the plane of the paper. As shown in FIG. 2A, fibers 8 and 11 have initially been draped over wires 9 and 12, respectively. Because of the air currents generated by the impact elements as they sweep past the surface of the screen 7, both fibers have a tendency to move in the direction of the small arrows as shown. FIG. 2B illustrates the positions of fibers 8 and 11 a fraction of a second later. As shown, fiber 8 has slid along wire 9 causing it to jam into the crevice created by the intersection of wires 9 and 12. On the other hand, the air currents do not tend to move fiber 11 into such a crevice since the air currents are generally normal to wire 12. Hence, fiber 11 can gradually work its way free as shown due to uneven drag forces on different parts of the fiber. Those portions of the fiber closer to the impact elements experience greater drag force, causing eventual loosening of the fiber from the wire. In addition, the wake of the impact elements helps lift the fibers off the wire.

Another difficulty with the use of wire screens is that fiber aggregates can lodge themselves in the mesh openings if the openings are too small. On the other hand, the aggregates will pass through the mesh openings if they are too large. The first situation is undesirable because the throughput capacity of the apparatus is diminished. The second situation is of course undesirable because the product will contain a large number of fiber aggregates instead of solely individual fibers.

On the other hand, the outlet of an apparatus of this invention, a section of which is illustrated in FIG. 3, to a large extent overcomes these difficulties. Shown is an impact element 1 which is driven by a rotating shaft 14 in the arcuate path indicated by arrow 2. The outlet of the apparatus is generally indicated by reference numeral 3. As shown, the outlet consists essentially of a series of spaced-apart parallel plates 5 having a rectangular cross-section as viewed from the ends 15. Each of the plates has a leading surface 16 which generally faces the approaching impact elements. The leading surfaces are preferably as smooth as possible to prevent fibers from clinging to the surfaces. The orifice or space between the plates is preferably a continuous slot. In operation, the individual fibers tend to align themselves parallel to the air currents between the impact elements and the internal surface and eventually find their way through the outlet by passing between the plates 5. The distance between the plates can vary greatly depending upon the degree of classification or throughput desired. If only individual fibers are acceptable, the spacing between the plates will tend to be tighter than if some small aggregates are also acceptable. A spacing of about $\frac{1}{8}$ to about 3/16 has worked well for producing product consisting essentially of individual fibers. Fiber aggregates or clumps of fibers will be hurled against the leading faces or surfaces of the plates and, due to the degree of slant, will be deflected back into the apparatus rather than be carried by the air currents and pass between the plates. This deflecting action is repeated until the aggregate is broken down into individual fibers or smaller aggregates which do not have sufficient momentum and therefore follow the bending air currents into the slot. It will be appreciated that optimal results will depend on a variety of factors such as the speed of the impact elements, the width of the slot, the characteristics of the fibers and their aggregates, the clearance between the impact elements and the dividers, the degree of slant of the leading surface of the dividers relative to the direction of travel of the impact elements, the air flow rate through the apparatus, etc.

Figure 4:
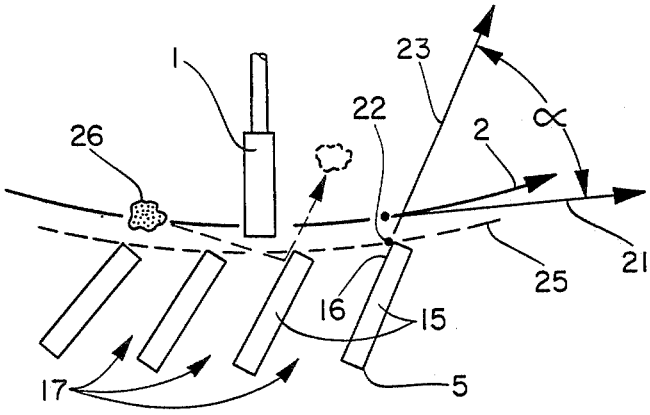
FIG. 4 shows a cross-sectional view of the outlet of the apparatus of FIG. 3.

FIG. 4 is a side view of the apparatus shown in FIG. 3, more clearly illustrating the concept of this invention. In order to define what is meant by "inwardly slanted in the direction of travel of the impact elements" it is necessary to draw two vectors. Vector 21 represents the direction of travel of the passing impact element relative to point 22 of plate 5, which is closest to the passing impact element. Vector 23, which represents the inward slant of the leading surface of the divider, is a vector drawn from point 22 toward the inside of the apparatus along the line which represents the intersection of the plane of the leading surface 16 with a plane containing point 22 and defined by the arc of a point on the travelling impact element. Vectors 21 and 23, being in the same plane, intersect and form an acute angle as shown. Thus, for purposes herein, a leading surface is considered as being inwardly slanted in the direction of travel of the impact element when the angle is an acute angle. Also shown are the continuous slots 17 between the plates. The dashed line 25 (also shown in FIGS. 1, 5, 6, and 7) represents an imaginary extension of the internal surface extended through the outlet to provide a line of reference. The innermost portions of the dividers preferably do not extend inwardly (toward the inside of the apparatus) beyond the dashed line 25 in order to maintain the same clearance which exists between the impact elements and the internal surface of the chamber. The effectiveness of this arrangement for rejecting aggregates of fibers is illustrated by the dashed path of fiber aggregate 26, shown deflecting off of the leading surface 16. One can see that if the fiber aggregate strikes the ridges at a very shallow angle (nearly parallel to the direction of travel of the impact elements) the inward slant of the leading face of the divider need not be as great as if the fiber aggregate approaches at a steeper angle. It may be necessary to do some experimentation to determine the optimum angle for a particular system, but an inward slant of about 45° has been found to work very well. It is within the scope of this invention that the dividers be other than plates as shown, but plates are very convenient. For example, by cutting a series of bevelled continuous or semi-continuous slots out of a very thick solid surface, the same effect can essentially be achieved.

Figure 5:
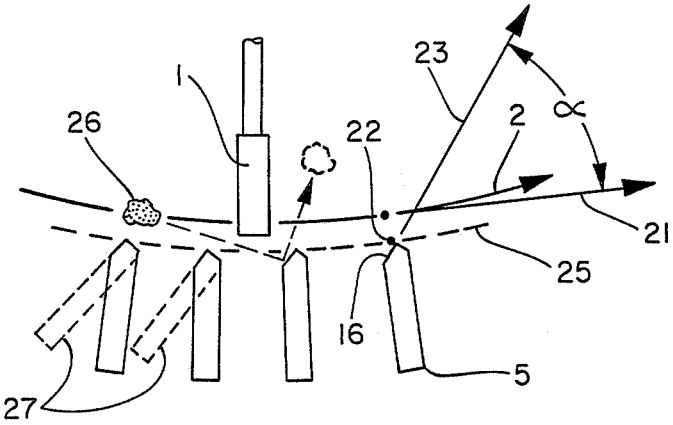
FIG. 5 shows a cross-sectional view similar to FIG. 4, illustrating an alternative design for the construction of the outlet in accordance with this invention.

FIG. 5 is similar to FIG. 4, simply illustrating a slightly different profile for the innermost portion of the dividers. The leading surfaces of the innermost portion of the dividers of FIG. 5 are identical to those of FIG. 4, except the pathway taken by escaping fibers has been slightly altered by the orientation of the dividers extending downwardly further into the outlet. The dashed lines 27 show the position of the plates in FIG. 4 for comparison. The manner in which fiber aggregates are deflected is the same for the apparatus of FIGS. 4 and 5.

Figure 6:
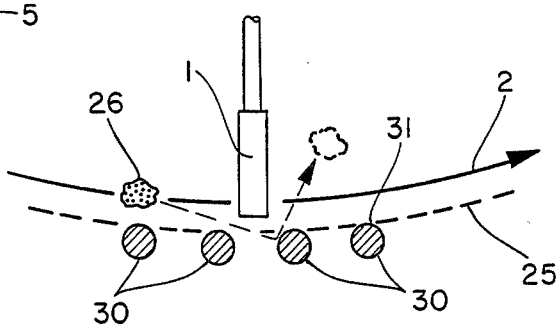
FIG. 6 shows a cross-sectional view similar to FIG. 5, illustrating another alternative for the outlet in accordance with this invention.

FIG. 6 illustrates another embodiment of this invention, wherein the dividers consist of a series of parallel rods 30. In this embodiment, the leading surface of the rod is inwardly slanted in the direction of travel of the impact elements as with the other embodiments, but because of the curved or rounded surface, the degree of inward slant changes from point to point. It is especially important with this embodiment that the rods be spaced closely enough to prevent fiber aggregates from striking the lower half of the rods and being deflected downwardly through the outlet. When using rods, there is an advantage in having the diameter of each rod sufficiently large enough to prevent a fiber from wrapping itself halfway or more around the rod. Hence, if a large enough rod is used, stapling of the fibers can be prevented.

Figure 7:
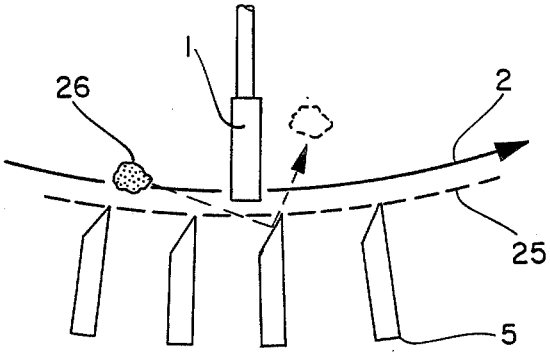
FIG. 7 shows still another alternative embodiment of the outlet similar to those shown in FIGS. 4, 5, and 6.

FIG. 7 illustrates yet another embodiment of this invention having a slightly modified divider profile as shown.

It will be appreciated that the foregoing Drawing and detailed discussion is for purposes of illustration only and is not to be construed as limiting the scope of the invention, which is defined by the following claims.

I claim:

1. In an apparatus for processing fibrous materials having arcuately travelling impact elements enclosed within a chamber by an internal surface arcuately spaced apart from said impact elements, wherein said chamber contains an outlet having a multiplicity of openings through which fibers leave the apparatus, the improvement comprising an outlet consisting essentially of a plurality of spaced-apart dividers aligned in a direction perpendicular to the direction of travel of the impact elements and having a leading surface or portion thereof which is inwardly slanted in the direction of travel of the impact elements, said dividers being separated by continuous or semi-continuous slots having a widthwise dimension substantially less than the lengthwise dimension separating any surface interruptions connecting opposite sides of said slot.

2. The apparatus of claim 1 wherein the leading surface of the dividers is planar.

3. The apparatus of claim 2 wherein the outlet comprises a series of spaced-apart parallel plates.

4. The apparatus of claim 3 wherein the plates are inwardly slanted at an angle of about 45° to the direction of travel of the impact elements.

5. The apparatus of claim 4 wherein the plates are spaced apart about $\frac{1}{8}$ inch.

6. The apparatus of claim 1 wherein the leading surface of the dividers is curved.

7. The apparatus of claim 6 wherein the dividers consist essentially of a series of spaced-apart parallel rods.

8. The apparatus of claim 1 wherein the impact elements are hammers.

9. The apparatus of claim 1 wherein the impact elements are blades.

* * * * *